United States Patent [19]

Stoll

[11] 4,449,609

[45] May 22, 1984

[54] MUFFLER FOR PNEUMATIC APPARATUS

[76] Inventor: Kurt Stoll, Lenzhalde 72, 7300 Esslingen, Fed. Rep. of Germany

[21] Appl. No.: 403,168

[22] Filed: Jul. 29, 1982

[30] Foreign Application Priority Data

Jul. 31, 1981 [DE] Fed. Rep. of Germany ..... 3130292

[51] Int. Cl.[3] ..... F01N 1/10; F01N 1/18

[52] U.S. Cl. ..... 181/230; 181/239; 181/241; 181/243; 181/256

[58] Field of Search ..... 181/230, 237, 241, 254, 181/243, 252, 258, 239, 256, 267

[56] References Cited

U.S. PATENT DOCUMENTS 3,547,223 12/1970 Gibel ..... 181/230
3,561,561 2/1971 Trainor ..... 181/267
4,226,298 10/1980 Bancel et al. ..... 181/241 X
4,367,807 1/1983 Fink et al. ..... 181/243 X

FOREIGN PATENT DOCUMENTS 1744655 2/1957 Fed. Rep. of Germany .
590873 4/1959 Italy ..... 181/258

*Primary Examiner*—Benjamin R. Fuller
*Attorney, Agent, or Firm*—Flynn, Thiel, Boutell & Tanis

[57] ABSTRACT

A muffler for use with pneumatically powered apparatus has a cylindrical housing with air outlet slots, to the back of which there is a pipe-like damper cartridge. Within the cartridge there is an axially adjustable choke body whose choke head is guided with a sliding fit by radial nosepieces resting against a support sleeve for the damper cartridge. A coned air flow controlling part of the choke head is used together with a coned face of the inner end of a connection inlet hole of the housing for forming an adjustable choke gap.

6 Claims, 1 Drawing Figure

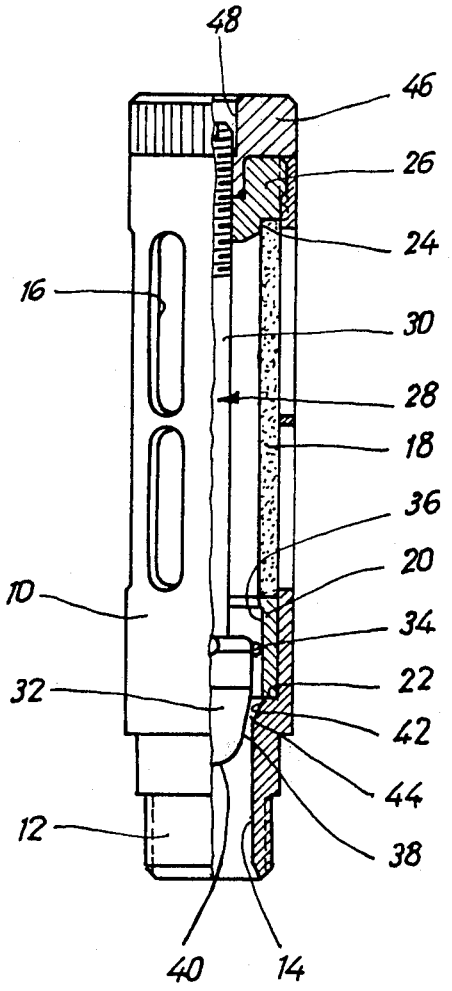
48
46
26
24
16
30
28
18
36
20
10
34
22
32
42
44
12
38
40
14

MUFFLER FOR PNEUMATIC APPARATUS

FIELD OF THE INVENTION

The present invention relates to a muffler or silencer for use on air-powered apparatus, having a tubular housing with air outlet openings in its wall and with a connector, a pipe-like damper cartridge in the housing and a stopper which may be undone from the housing and which is used for keeping the damper cartridge in position axially.

BACKGROUND OF THE INVENTION

Such mufflers are frequently used on air-powered apparatus for smoothing out pressure surges produced when air is suddenly let off from part of the apparatus into the outside atmosphere with the production of undesired noise. In this respect, the damper cartridge has the function of turning the more or less directed, powerful jet of compressed air into a diffuse air flow at a low speed. Such mufflers may be matched or geared to the amount of energy to be dissipated or to the surge characteristics of the exhaust from the pneumatic apparatus, with which the muffler is joined, by having different degrees of porosity in the cartridge so that there is a different choke property.

This sort of matching of the properties of the muffler to compressed air-powered apparatus makes it on the one hand necessary for different sorts of damper cartridges to be kept in stock and furthermore, even so, the properties of the choke of the muffler may not be steplessly adjusted to the needs of the pneumatic apparatus.

General outline of the invention

For this reason, one purpose of the present invention is that of making such a further development in the design of mufflers of the sort noted that the choke properties may be smoothly and steplessly adjusted.

For effecting this purpose, and further purposes, a muffler or silencer for use on air-powered apparatus is provided, having a tubular housing with air outlet openings in its wall and with a connector. A pipe-like or elongate and hollow cylindrical damper cartridge is provided in the housing. Further, a stopper is provided which may be undone from the housing and which is used for keeping the damper cartridge in position axially. In the central opening through the damper cartridge there is an axially adjustable choke body having a choke head next to the connector and walling in, together with an air flow control face in the housing, an adjustable choke gap.

Putting it differently, it may be seen that in the present invention a muffler has an adjustable choke as part of it without making the overall size of the muffler any greater. Such a muffler may, for this reason, be used anywhere in which prior art mufflers have so far been used, if desired. Furthermore, in structure, the muffler of the present invention is hardly any more complex.

As part of one such further development, the choke body, at its end furthest from the choke head, has a screwthread screwed into a thread in the stopper, thus making it possible it for the choke properties of the muffler to be readily changed as desired, even when the choke has been fixed to the pneumatic apparatus, so that the best possible adjustment to the needs of the running apparatus may be produced.

Furthermore, the choke head may have guiding nosepieces engaging a guide face within the housing, thus making certain that the choke head is kept safely in a position radially and that it is not pushed out of position by pressure surges, while at the same time keeping a free space round the choke head so that the choking properties are dependent on the choke gap between the air flow control part of the choke head and the air flow control face on an inner wall of the housing.

Furthermore, such a guide face may be the inner face of a support ring within the housing, against which the end face of the damper cartridge nearest to the connector is rested. The support ring may be taken out of the housing if desired. With such a design it is simpler for the different parts of the muffler to be put together.

For producing good input flow conditions at the choke head, the head may have a part-spherical end part.

The choke head may furthermore have a conical-shaped air flow control part so that the size of the choke gap between the choke head and the air flow control face of the housing will be linearly dependent on adjustment of the choke body.

The conical-shaped air flow control face in the housing may be formed by a conically cut part of the hole through the connector, thus making it simpler for the muffler housing to be produced and furthermore there are no sharp edges in the way of the incoming air.

As a further useful development of the invention, the end of the choke body nearest to the stopper may have a groove for receiving the blade of a screwdriver therein, there being a little opening through a grip part of the stopper for this purpose. This makes it possible for the stopper to be readily screwed and unscrewed, while at the same time it is simple for the user to get at the adjustment end of the choke body.

DETAILED ACCOUNT OF WORKING EXAMPLE OF THE INVENTION TO BE SEEN IN THE FIGURE

Turning now to the single FIGURE, which is a side view and part-axial section of a muffler for pneumatic apparatus, having an adjustable choke within it, it will be seen that such muffler has a cylindrical housing 10 in the form of an aluminum die casting. The lower end of housing 10 has a threaded connector 12 designed to be screwed into, for example, the exhaust opening of a control valve for a pneumatic servomotor or actuator. Connector 12 has a connection opening 14 therein.

The wall of housing 10 has a number of outlet slots 16 within which there is a pipe-like or an elongate and cylindrical damper cartridge 18 made of a porous material as for example of sintered synthetic resin.

The lower end of the damper cartridge 18 is rested against a support ring 20 which, for its part, is positioned against a shoulder 22 in the housing 10. The top end of the damper cartridge 18 is received in an edge groove 24, forming a shoulder on the lower end of a stopper 26 and is positioned by an axial force acting thereon. The stopper 26 is screwed into the top end of the housing 10.

Within the damper cartridge 18, there is a choke body generally numbered 28 and consists of an elongate stem 30 and a choke head 32.

The free end of the stem 30 has a groove extending thereacross into which the blade of a screwdriver can be inserted. Furthermore, this free end of the stem 30 has a male thread threadedly received in a matching female thread in the stopper 26.

The choke head 32 has four radial guide nosepieces 34 equidistantly spaced from each other, the nosepieces 34 resting against a cylindrical guide face 36 on the inside of the support ring 20 with a sliding fit. An air flow controlling part 38 of choke head 32 is conical-shaped and terminates in a part-spherical end part 40 of the choke head 32.

The air flow controlling part 38 has the function, together with an air flow control face inside the housing (formed by a conical face or seat 42 of the inner end of the connection hole 14), of forming a choke gap 44 whose size may be changed by axial adjustment of choke body 28 using a screwdriver.

For making it simpler for the stopper 26 to be screwed in, it has a knob member secured thereto with a knurled outer face 46 and a central hole 48 thereby making it possible for the user to get at the end of stem 30.

I claim:

1. In a muffler for use on pneumatic apparatus, said muffler having a hollow cylindrical housing with a connector means at one end and outlet openings, a hollow cylindrical damper cartridge made of a porous material and mounted inside said housing, wihin which hollow cartridge is arranged an axially adjustable choke member, said choke member having a choke head on an end thereof which faces said connector means, which together with a housing-fixed portion defines a variable choke gap therebetween, and a releasable knob member for axially fixedly orienting said damper cartridge in said housing, the improvement comprising wherein said outlet openings consist of elongate outlet slots which are provided in the peripheral wall of said housing and provides communication between the interior and exterior of said housing through said damper cartridge, wherein said choke head has a conically-shaped control section converging to a partial spherical end section, wherein said housing-fixed portion is a chamfered conically-shaped surface and wherein said choke head is provided with plural guide noses which slidingly engage a housing-fixed guide surface intermediate said housing-fixed portion and said damper cartridge to maintain a desired and thereby controlled spacing between the peripheral surface of said choke head and said guide surface as well as said housing-fixed portion.

2. The muffler as claimed in claim 1, wherein said knob member includes a stopper coupled to an end of said damper cartridge remote from said housing-fixed portion and wherein said choke member has a choke body at an end thereof remote from said choke head, and a screwthread thereon which threadedly engages a matching thread in said stopper.

3. The muffler as claimed in claim 1, wherein said housing-fixed guide surface is provided on a support ring forming a part of said housing, said support ring being formed with an end face against which an end of said damper cartridge, nearest to said connector means, is supported, said support ring being removably oriented in said housing.

4. The muffler as claimed in claim 1, wherein said choke head has an outwardly flared, conically-shaped air flow control part inwardly of said partial spherical end section.

5. The muffler as claimed in claim 1 or claim 2, werein said housing-fixed portion defines an air flow control face and is in the form of a conically-shaped hole extending through said connector means.

6. The muffler as claimed in claim 2, wherein an end of said choke body remote from said connector means has means thereon adapted to operatively engage an adjustment tool to facilitate an adjustment of the axial spacing between said choke head and said housing-fixed portion.

* * * * *